US007745750B2

(12) United States Patent
Hewson et al.

(10) Patent No.: US 7,745,750 B2
(45) Date of Patent: Jun. 29, 2010

(54) DIMMER SWITCH HAVING AN ILLUMINATED BUTTON AND SLIDER SLOT

(75) Inventors: John Hewson, Philadelphia, PA (US); Matthew J. Ochs, Macungie, PA (US); Jennifer S. Wilkinson, Bethlehem, PA (US)

(73) Assignee: Lutron Electronics Co., Inc., Coopersburg, PA (US)

( * ) Notice: Subject to any disclaimer, the term of this patent is extended or adjusted under 35 U.S.C. 154(b) by 388 days.

(21) Appl. No.: 11/725,018

(22) Filed: Mar. 16, 2007

(65) Prior Publication Data

US 2007/0217211 A1 Sep. 20, 2007

Related U.S. Application Data

(60) Provisional application No. 60/783,528, filed on Mar. 17, 2006.

(51) Int. Cl.
*H01H 23/00* (2006.01)

(52) U.S. Cl. ..... 200/339; 200/315

(58) Field of Classification Search ..... 200/241, 200/252, 314, 315, 329–335, 339, 341, 520, 200/530, 536, 547; 362/418, 430
See application file for complete search history.

(56) References Cited

U.S. PATENT DOCUMENTS

| | | | |
|---|---|---|---|
| 3,864,561 | A | 2/1975 | Spira et al. |
| 4,455,546 | A | 6/1984 | Roszel |
| 4,787,722 | A | 11/1988 | Claytor |
| 4,939,383 | A | 7/1990 | Tucker et al. |
| 4,947,054 | A | 8/1990 | Flowers et al. |
| 4,988,840 | A | 1/1991 | Carson et al. |
| 5,017,837 | A | 5/1991 | Hanna et al. |
| 5,099,193 | A | 3/1992 | Moseley et al. |
| 5,237,264 | A | 8/1993 | Moseley et al. |
| 5,262,678 | A | 11/1993 | Flowers et al. |
| 5,359,231 | A | 10/1994 | Flowers et al. |
| 5,399,940 | A | 3/1995 | Hanna et al. |
| 5,637,930 | A | 6/1997 | Rowen et al. |
| 6,005,308 | A | 12/1999 | Bryde et al. |
| 6,727,446 | B1 | 4/2004 | Mayo et al. |

(Continued)

FOREIGN PATENT DOCUMENTS

| | | |
|---|---|---|
| EP | 0 355 482 A1 | 2/1990 |

(Continued)

*Primary Examiner*—Renee Luebke
*Assistant Examiner*—Marina Fishman
(74) *Attorney, Agent, or Firm*—Ostrolenk Faber LLP

(57) ABSTRACT

A dimmer switch for controlling the amount of power delivered to an electrical load from an AC power source provides a night light feature on a user interface adapted to be provided in an opening of a traditional-style faceplate. The user interface comprises a frame, a pushbutton actuator, and an intensity actuator. Actuations of the pushbutton actuator change an internal switch mechanism between an open position and a closed position. A source of illumination, mounted internally to the dimmer switch and offset longitudinally from the switch mechanism, illuminates the pushbutton actuator and an elongated slot of the intensity actuator when the lighting load is off to provide the night light feature. The dimmer switch further comprises a plurality of lenses operable to redirect the light from the source of illumination towards the pushbutton actuator and the elongated slot.

32 Claims, 13 Drawing Sheets

U.S. PATENT DOCUMENTS

| | | | |
|---|---|---|---|
| 6,734,381 | B2 | 5/2004 | Mayo et al. |
| 6,774,328 | B2 | 8/2004 | Adams et al. |
| 7,105,763 | B2 | 9/2006 | Adams et al. |
| 7,361,853 | B2 | 4/2008 | Clegg et al. |
| 7,414,210 | B2 | 8/2008 | Clegg et al |
| 7,432,460 | B2 | 10/2008 | Clegg et al |
| 7,432,463 | B2 | 10/2008 | Clegg et al |
| 2006/0255959 | A1 | 11/2006 | Salvestrini |

FOREIGN PATENT DOCUMENTS

| | | | |
|---|---|---|---|
| WO | WO 85/04280 | A | 9/1985 |

DIMMER SWITCH HAVING AN ILLUMINATED BUTTON AND SLIDER SLOT

RELATED APPLICATIONS

This application claims priority to commonly-assigned U.S. Provisional Application Ser. No. 60/783,528, filed Mar. 17, 2006, entitled DIMMER SWITCH HAVING AN ILLUMINATED BUTTON AND SLIDER SLOT, the entire disclosure of which is hereby incorporated by reference.

FIELD OF THE INVENTION

The present invention relates to load control devices for controlling the amount of power delivered to an electrical load, specifically a dimmer switch that controls the intensity of a lighting load and includes a control button and a linear slider.

DESCRIPTION OF THE RELATED ART

A conventional wall-mounted load control device is mounted to a standard electrical wallbox and is connected in series electrical connection with an electrical load. Standard load control devices, such as dimmer switches and motor speed controls, use one or more semiconductor switches, such as triacs or field effect transistors (FETs), to control the current delivered from an alternating-current (AC) power source to the load, and thus, the intensity of the lighting load or the speed of the motor.

Wall-mounted load control devices typically include a user interface having a means for adjusting the intensity or the speed of the load, such as a linear slider, a rotary knob, or a rocker switch. Some load control devices also include a button that allows for toggling of the load from off (i.e., no power is conducted to the load) to on (i.e., power is conducted to the load). Furthermore, it is often desirable to provide a night light on the load control device. The night light illuminates when the controlled lighting load is off to allow a user to locate the load control device in a dark room.

FIG. 1 shows the user interface of a prior art dimmer switch 10 having a night light which illuminates a toggle switch 12. As shown, the dimmer 10 comprises a faceplate 14, a bezel 16, an enclosure 18, the toggle switch 12, and a slider control 20. Actuating the upper portion of the toggle switch 12 closes a mechanical switch inside the dimmer, which connects the AC power source to the lighting load. Actuating the lower portion of the toggle switch 12 opens the mechanical switch, thereby disconnecting power from the lighting load. The slider control 20 comprises an actuator knob 22 mounted for sliding movement in an elongated slot 24. Moving the actuator knob 22 to the top of the elongated slot 24 increases the intensity of the controlled lighting load and moving the actuator knob 22 to the bottom of the elongated slot 24 decreases the intensity of the controlled lighting load.

The night light feature of the dimmer switch 10 is provided by a neon lamp, which is physically located immediately behind the toggle switch 12. The neon lamp is illuminated when the lighting load is off and not illuminated when the lighting load is on. The intensity actuator 20 is not illuminated by the night light.

There is an aesthetic and functional benefit to illuminating the intensity actuator 20 when the lighting load is off. Thus, there is a need for a load control device comprising a toggle button and an intensity actuator that are both illuminated when the controlled load is off.

SUMMARY OF THE INVENTION

According to the present invention, a load control device for controlling the amount of power delivered to an electrical load from an AC power source comprises a frame, a pushbutton actuator, an intensity actuator, and a source of illumination. The frame defines an opening in a front surface of the load control device. The pushbutton actuator is disposed within the opening. The pushbutton actuator includes a substantially translucent front wall having an outer front surface and an inner front surface, and translucent side walls having outer surfaces and inner surfaces. The intensity actuator is disposed within the opening adjacent the pushbutton actuator. The intensity actuator including an elongated slot formed in the frame and an intensity actuator knob slidingly received within the slot. The source of illumination is disposed within an interior portion of the load control device and is in optical communication with the inner front surface of the front wall of the pushbutton actuator, the inner surfaces of the side walls of the pushbutton actuator, and the slot of the intensity actuator frame. When the source of illumination is illuminated, a soft glow of light is perceptible through the pushbutton actuator and through the slot.

According to second embodiment of the present invention, a wall-mountable electrical load control structure for controlling the power to be applied to an electrical load comprises a support frame, an enclosure, a generally-flat cover plate, an elongated rectangular pushbutton a switch mechanism, and a source of illumination. The support frame has a front surface and a rear surface. The front surface defines an elongated rectangular opening therein and the rectangular opening has a length, which is greater than its width. The enclosure is secured to and extends from the rear surface of the support frame. The generally-flat cover plate is secured relative to the front surface of the support frame. The cover plate defines a plane and has a centrally disposed rectangular opening. The elongated rectangular pushbutton is slidably received with respect to the elongated opening of the support frame, passes through the rectangular opening in the cover plate, and is moveable perpendicularly to the plane of the cover plate. The switch mechanism is supported in the enclosure and coupled to the elongated pushbutton, such that the pushbutton is operable to cause the switch mechanism to turn the power to the electrical load on and off in response to the operation of the pushbutton. The source of illumination is supported behind the support frame and being electrically energized when the power to the electrical load is turned off. The pushbutton has at least a translucent surface portion, which is positioned to be illuminated by the source of illumination when the source of illumination is energized.

According to a third embodiment of the present invention, the wall-mountable electrical load control structure further comprises a variable-intensity control circuit coupleable to the electrical load, and a slider control for varying the intensity control circuit to control the amount of power delivered to the electrical load. The slider control comprises a shaft that extends perpendicularly through a vertical slot of the support frame and has an operating knob at its outer end and connected to the variable-intensity control circuit at its other end. The slot is adapted to be illuminated by the source of illumination when the source of illumination is energized.

According to a third embodiment of the present invention, the wall-mountable electrical load control structure further comprises a thin shroud extending from the frame and into the rectangular opening in the cover plate. The elongated rectangular pushbutton extends through and is at least partly surrounded by the shroud. The shroud prevents the application of binding force to the rectangular pushbutton from the interior edges of the rectangular opening in the cover plate due to a lateral displacement of the rectangular force plate relative to the frame.

The present invention further provides a control structure for an electrical load comprising a flat surface defining a slot therein, a manually-operable toggle actuator, a variable-intensity slider control, and an illumination source. The manually-operable toggle actuator is coupleable to the electrical load for turning the load on and off. The variable-intensity slider control is coupleable to the electrical load for varying the current supplied to the load and comprises a manually operable slide shaft movable between the ends of the slot in the flat surface. The illumination source is positioned behind the slider and is connected to a control circuit. The illumination source is adapted to be illuminated when the current to the load is off. The illumination source illuminates the slot when the illumination source is illuminated.

In addition, the present invention provides a method of illuminating a slider slot of a wall-mounted dimmer switch to identify the location of the dimmer switch in a darkened room. The slider slot receives a dimmer slider knob that is moveable between the ends of the slot. The method comprises the steps of illuminating a light source contained interiorly of the dimmer switch, and directing the light source towards the rear of the slot. Illumination is visible in the portions of the slot which are unoccupied by the slider knob.

According to yet another aspect of the present invention, a control structure for an electrical circuit for controlling the power to be applied from an AC power source to an electrical system comprises a toggle button, a support structure, an optically-conductive structure, at least one light-emitting diode, a circuit for energizing the at least one light-emitting diode when the electrical circuit is off, and a lens structure. The toggle button has a flat rectangular hollow plastic body and a translucent outer front surface. The support structure supports the toggle button for linear motion perpendicular to the front surface. The optically-conductive structure is supported within the hollow plastic body of the toggle button and has a first end surface facing an interior surface of the translucent outer top surface and a second end surface opposite to the first end surface. The at least one light-emitting diode faces the second end surface for illuminating the second end surface whereby the light illumination on the second end surface is conducted to the first end surface to illuminate the translucent outer top surface. The lens structure directs light through the optically-conductive structure to more uniformly illuminate the translucent outer top surface.

Other features and advantages of the present invention will become apparent from the following description of the invention that refers to the accompanying drawings.

DETAILED DESCRIPTION OF THE INVENTION

Figure 1:
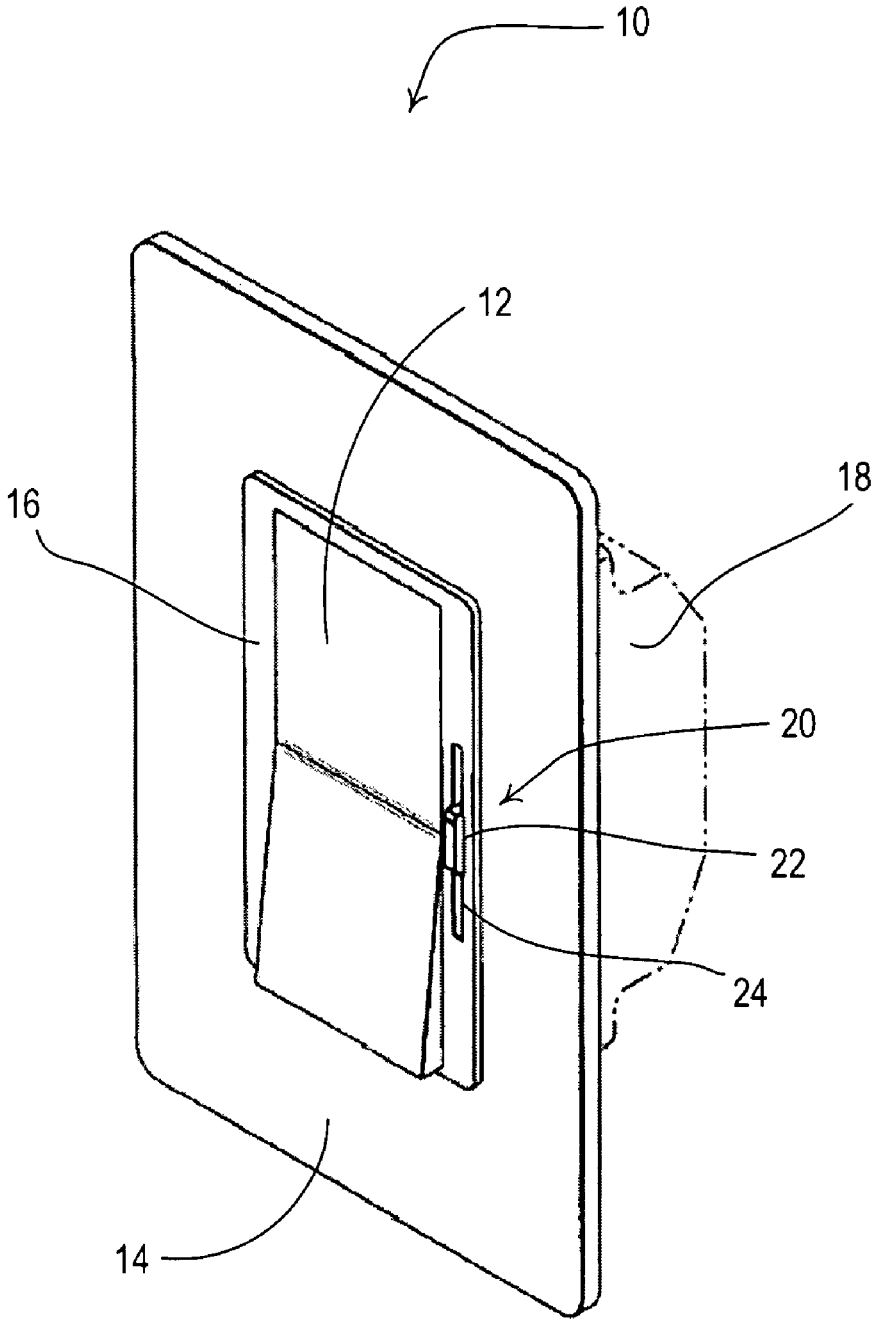
Fig. 1 Prior Art
FIG. 1 shows the user interface of a prior art dimmer switch having a night light which illuminates a toggle switch.

The foregoing summary, as well as the following detailed description of the preferred embodiments, is better understood when read in conjunction with the appended drawings. For the purposes of illustrating the invention, there is shown in the drawings an embodiment that is presently preferred, in which like numerals represent similar parts throughout the several views of the drawings, it being understood, however, that the invention is not limited to the specific methods and instrumentalities disclosed.

Figure 2:
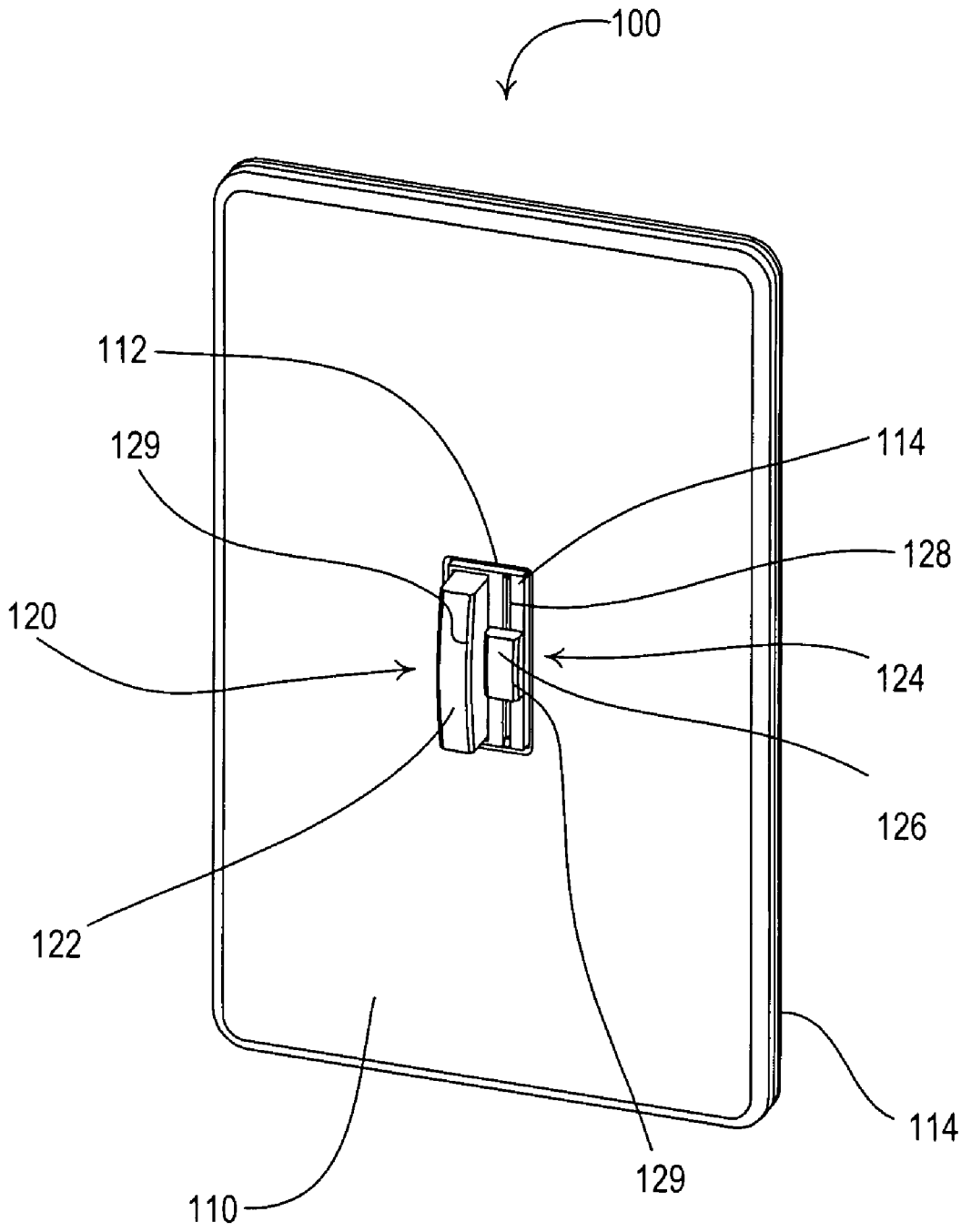
FIG. 2 is a perspective view of a dimmer switch according to the present invention.
Figure 3:
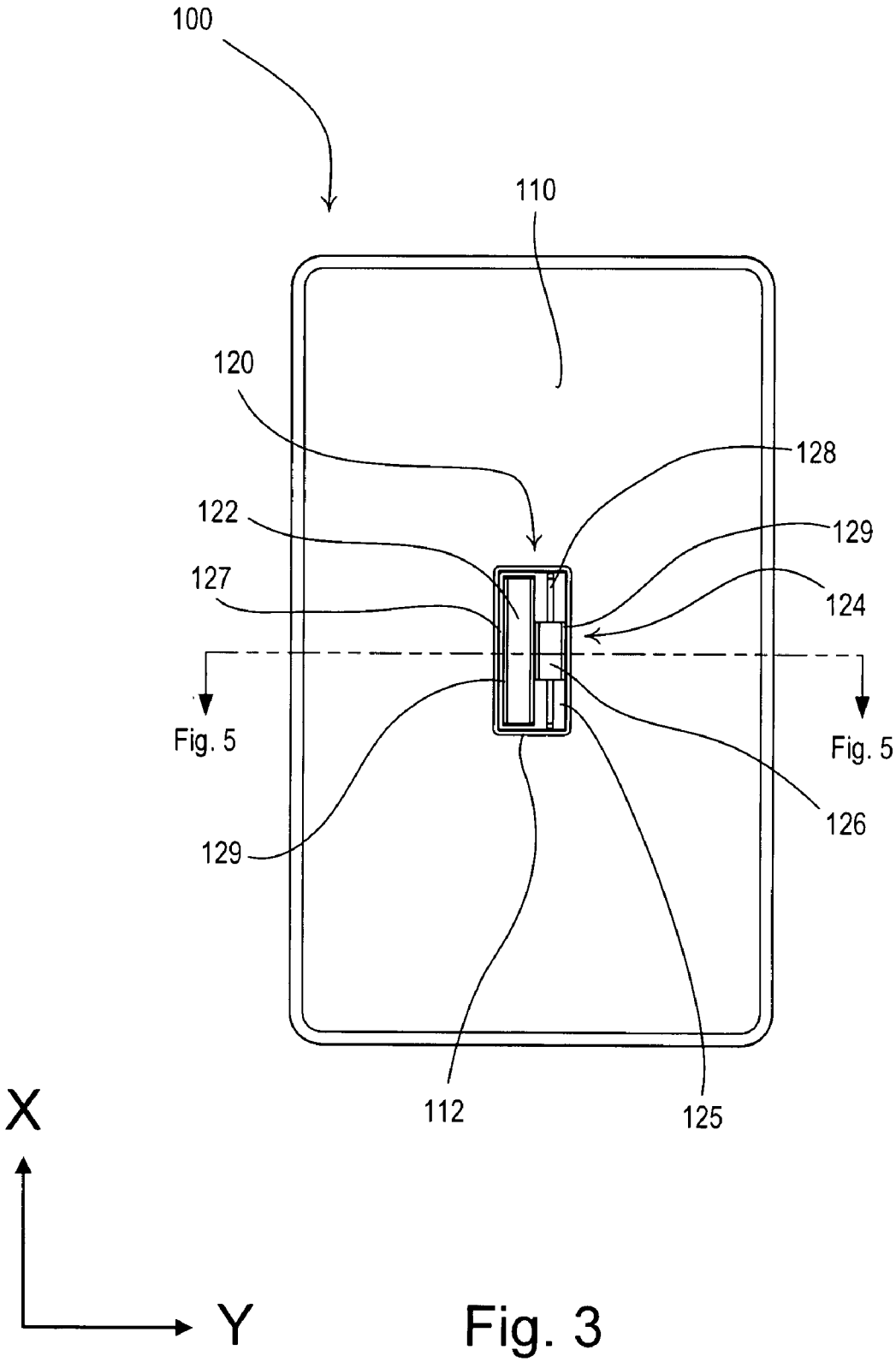
FIG. 3 is a front view of the dimmer switch of FIG. 2.
Figure 5:
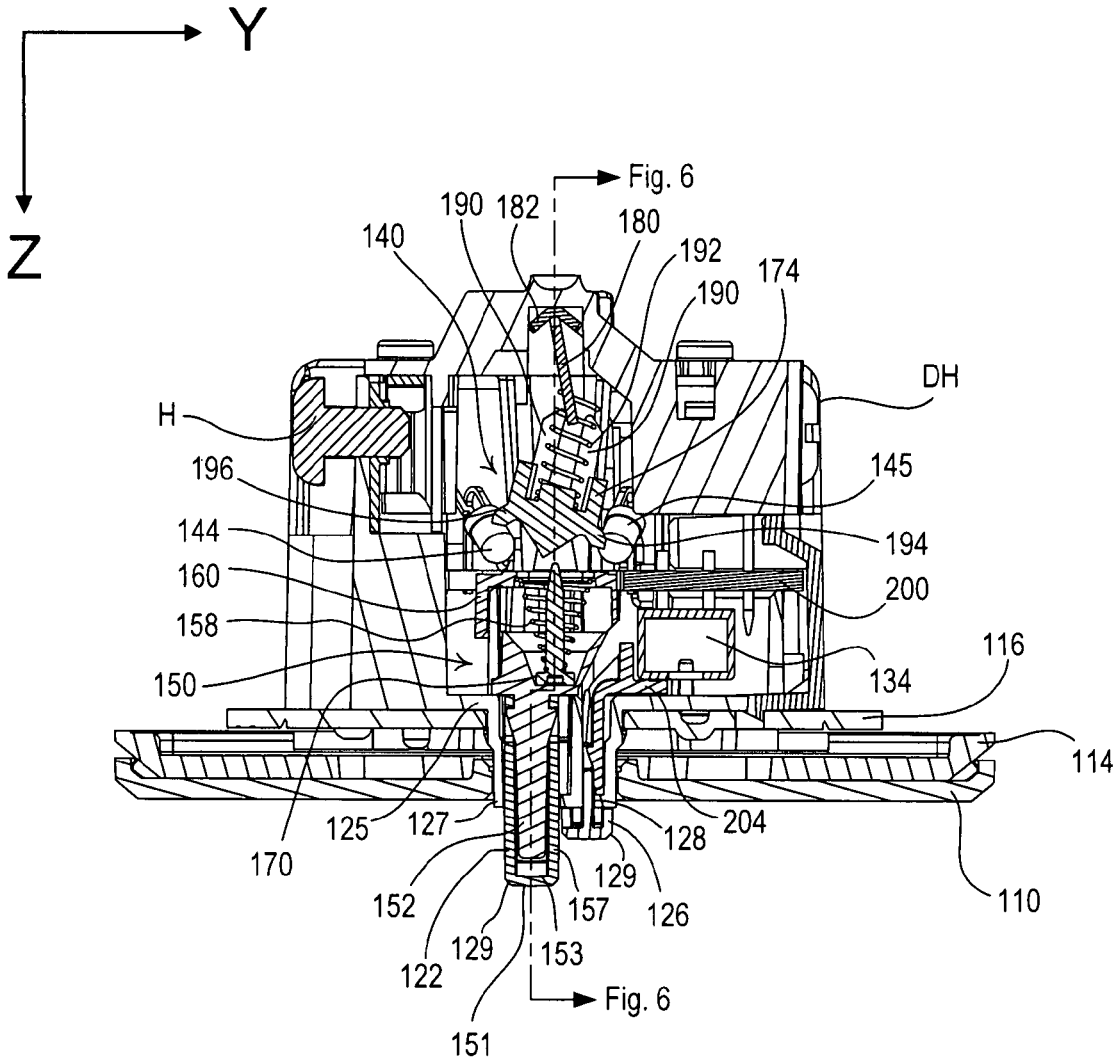
FIG. 5 is a top cross-sectional view of the dimmer switch of FIG. 2.
Figure 6:
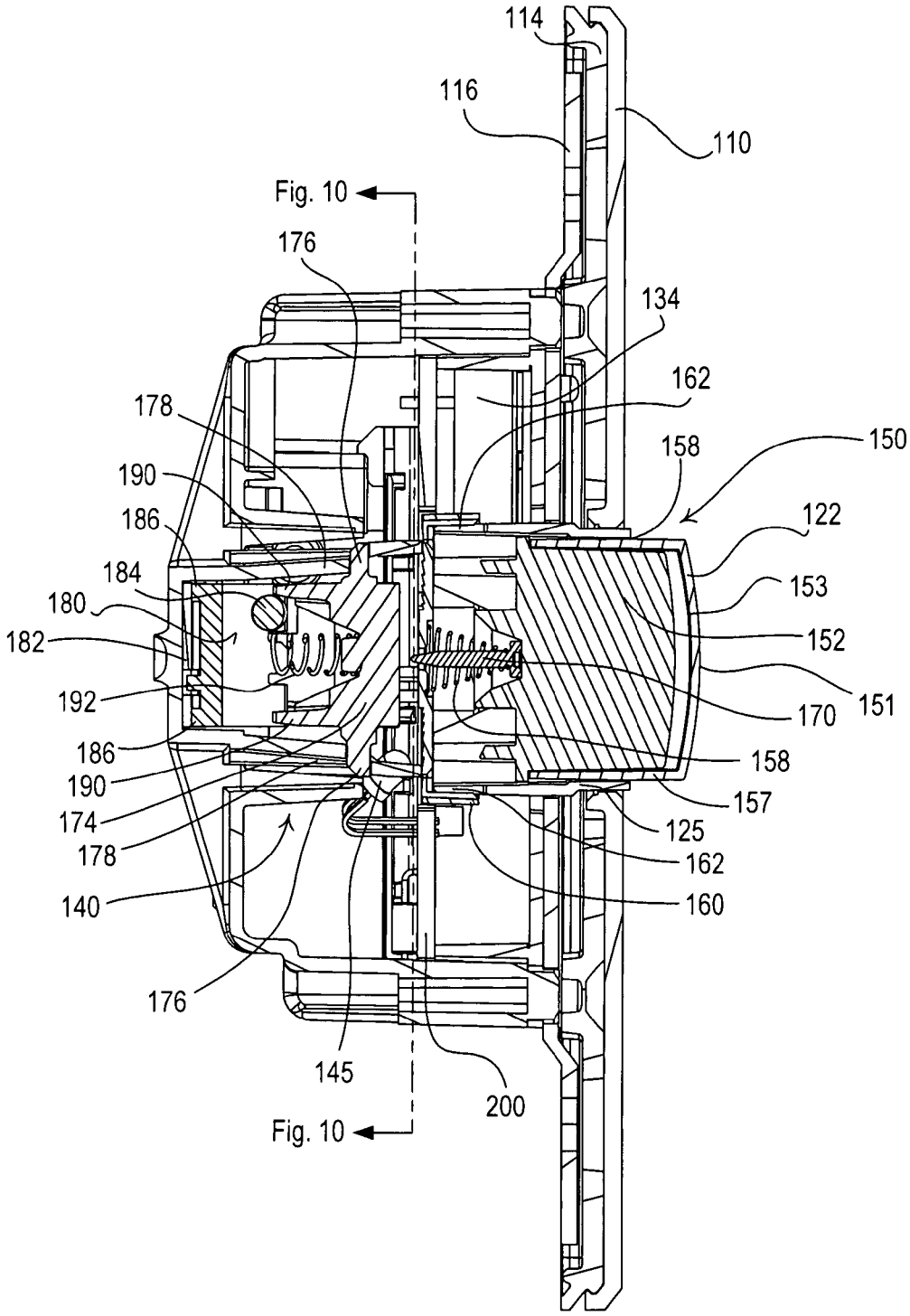
FIG. 6 is a left-side cross-sectional view of the dimmer switch of FIG. 2.

FIG. 2 is a perspective view and FIG. 3 is a front view of a wall-mountable dimmer switch 100 according to the present invention. The dimmer switch 100 comprises a generally-flat faceplate 110 (i.e., a cover plate) having a traditional-style opening 112. Per the standards set by the National Electrical Manufacturers Association (NEMA), the traditional-style opening 112 has a length in the longitudinal direction (i.e., in the direction of the X-axis as shown in FIG. 3) of 0.925" and a width in the lateral direction (i.e. in the direction of the Y-axis) of 0.401" (NEMA Standards Publication No. WD6, 2001, p. 7). The faceplate 110 is connected to an adapter 114, which is attached to a yoke 116 (FIGS. 5 and 6). The yoke 116 allows the dimmer switch 100 to be mounted to a standard electrical wallbox (not shown). The electrical circuitry of the dimmer switch 100, which will be described in greater detail below, is housed in a back enclosure 118 (FIGS. 5 and 6).

The dimmer switch 100 comprises a user interface 120, which includes an elongated rectangular pushbutton 122 (i.e., a toggle actuator) and an intensity actuator 124 (i.e., a variable-intensity slider control). The intensity actuator 124 comprises a rectangular actuator knob 126 (i.e., an operating knob), which allows for sliding movement between the ends of a vertical elongated slot 128. The pushbutton 122 is supported for inward translation with respect to a frame 125 in a sliding manner. The front surface of the pushbutton 122 and the front surface of the actuator knob 126 are substantially coplanar when the pushbutton 122 is fully depressed.

The frame 125 defines a thin rectangular shroud section 127 surrounding the pushbutton 122. The thin shroud section 127 prevents the application of binding force to the pushbutton from the interior edges of the opening 112 in the faceplate 110 due to a lateral displacement of the faceplate relative to the frame. The thin shroud section 127 forms an integrally molded plastic part with the frame 125. Preferably, the thin shroud section 127 is 0.030" thick.

Consecutive presses of the pushbutton 122 change an internal switch mechanism 140 (FIG. 4) between alternate positions, i.e., between an open position and a closed position. A connected electrical load, e.g., a lighting load 104 (FIG. 4) or a motor load (not shown), is on (i.e., energized) when the switch mechanism 140 is in the closed position and off (i.e., not energized) when the switch mechanism is in the open position. Adjustment of the intensity actuator 124 causes the dimmer switch 100 to change the amount of power delivered to the lighting load 104. Moving the actuator knob 126 towards the top end of the elongated slot 128 increases the intensity of a connected lighting load and moving the actuator knob 126 towards the bottom end of the elongated slot 128 decreases the intensity of the connected lighting load.

The length of the opening 112 in the faceplate 110 is only slightingly larger than the length of the pushbutton 122 and the width of the opening is only slightly larger than the sum of the widths of the pushbutton 122 and the actuator knob 126. The width of the pushbutton 122 is substantially equal to the width of the actuator knob 126 as shown in FIG. 3. The length of the actuator knob 126 is less than one half the length of the pushbutton 122. The pushbutton 122 has a top rectangular surface, which defines a positive curvature from its top to its bottom along the length of the surface. The pushbutton 122 and the actuator knob 126 have lateral edges 129 that are chamfered.

The dimmer switch 100 provides a night light feature when the switch mechanism 140 is in the open position and the lighting load 104 is off. Specifically, a source of illumination is provided behind the pushbutton 122, the actuator knob 126, and the elongated slot 128, such that the pushbutton and the elongated slot are illuminated dimly when the lighting load 104 is off to allow a user to easily locate the dimmer switch 100 in a dark room. When the lighting load 104 is on, the night light is not illuminated.

Figure 4:
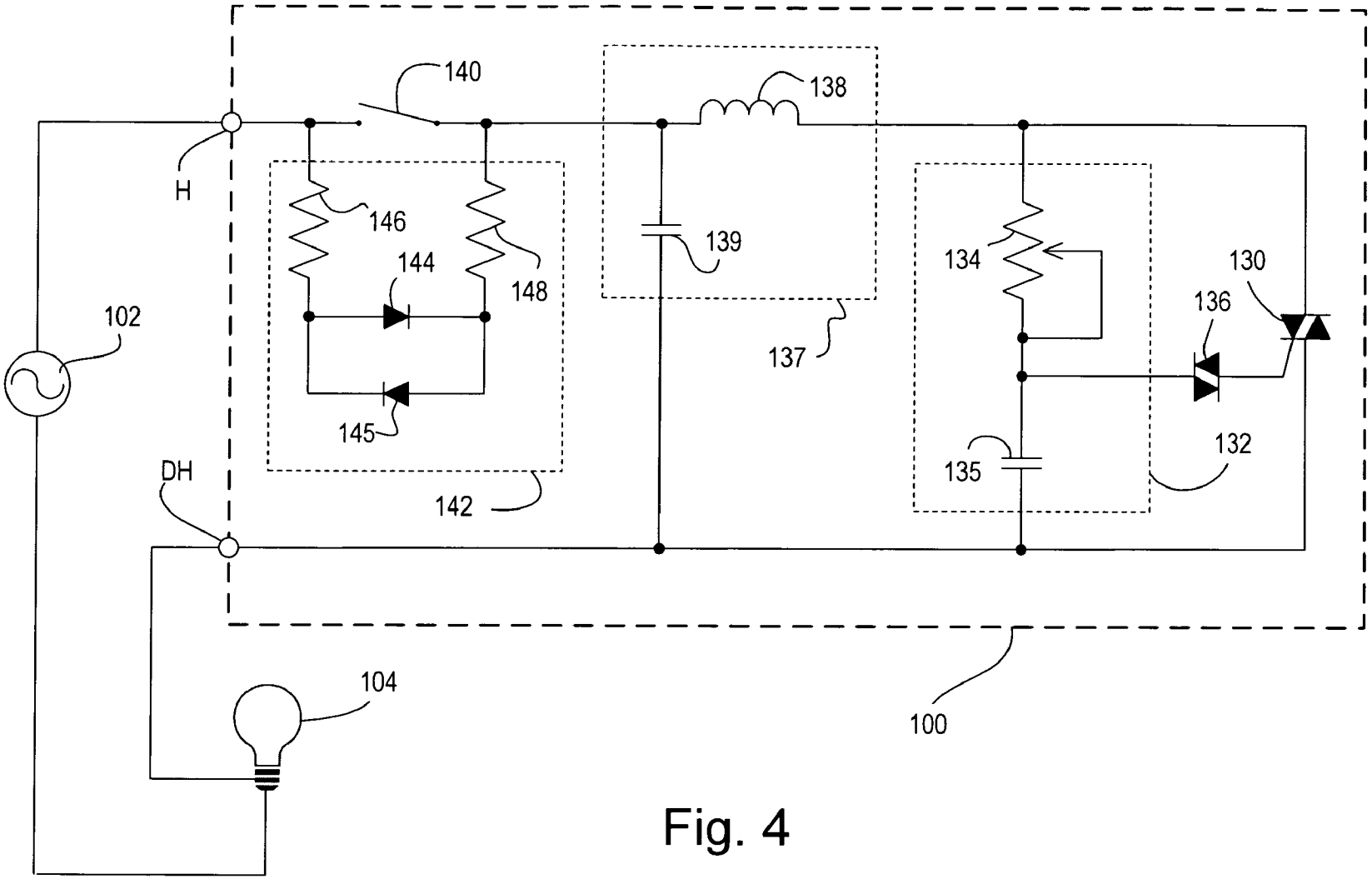
FIG. 4 is a simplified schematic diagram of the dimmer switch of FIG. 2.

FIG. 4 is a simplified schematic diagram of the dimmer switch 100. The dimmer switch 100 is coupleable to an AC power source 102 via a hot terminal H and to the lighting load 104 via a dimmed-hot terminal DH. The dimmer switch 100 comprises a variable-intensity control circuit having a triac 130, a timing circuit 132, and a diac 136. The triac 130 is adapted to be coupled in series electrical connection between the source 102 and the lighting load 104, so as to control the power delivered to the load. The triac 130 may alternatively be implemented as any suitable type of controllably conductive device, e.g., a relay or another type of bidirectional semiconductor switch, such as a field-effect transistor (FET) in a rectifier bridge, two FETs in anti-series connection, or one or more insulated-gate bipolar transistors (IGBTs). The triac 130 has a gate (or control input) for rendering the triac conductive. Specifically, the triac 130 becomes conductive at a specific time each half-cycle and becomes non-conductive when a load current through the triac becomes substantially zero volts, i.e., at the end of the half-cycle. The amount of power delivered to the lighting load 104 is dependent upon the portion of each half-cycle that the triac 130 is conductive.

The timing circuit 132 includes a resistor-capacitor (RC) circuit coupled in parallel electrical connection with the triac 130. Specifically, the timing circuit 132 comprises a potentiometer 134 in series with a capacitor 136. As the capacitor 135 charges and discharges each half-cycle of the AC power source 104, a voltage $v_C$ develops across the capacitor. The capacitor 135 begins to charge at the beginning of each half-cycle at a rate dependent upon the resistance of the potentiometer 134 and the capacitance of the capacitor 135.

The diac 136, which is employed as a triggering device, is coupled in series between the timing circuit 132 and the gate of the triac 130. The diac 136 is characterized by a break-over voltage $V_{BR}$ (for example 30V), and passes a gate current to and from the gate of the triac 130 when the voltage $v_C$ across the capacitor 135 exceeds the break-over voltage. The gate current flows into the gate of the triac 130 during the positive half-cycles and out of the gate of the triac during the negative half-cycles. The charging time of the capacitor 135, i.e., the time constant of the RC circuit, varies in response to changes in the resistance of potentiometer 134 to alter the times at which the triac 130 begins conducting each half-cycle of the AC power source 102. The potentiometer 134 is operably coupled to the actuator knob 126 of the user interface 120, such that a user is able to change the resistance of potentiometer 134 by manipulating the actuator knob 126. After the gate current flows through the gate of triac 130, the triac conducts a load current through the main load terminals, i.e., between the source 102 and the lighting load 104, until the load current drops to substantially zero amps near the end of the half-cycle of the AC power source 102.

The dimmer switch 100 includes an electromagnetic interference (EMI) filter 137 comprising an inductor 138 and a capacitor 139. The EMI filter 137 provides noise filtering of electromagnetic interference at the hot terminal H and the dimmed-hot terminal DH of the dimmer switch 100.

The switch mechanism 140 is coupled in series electrical connection with the hot terminal H and alternatively toggles between the open position and the closed position in response to actuations of the pushbutton 122. When the switch mechanism 140 is in the open position, the AC power source 102 is disconnected from the lighting load 104, and thus the lighting load is off. When the switch mechanism 140 is in the closed position, the AC power source 102 is coupled to the lighting load 104 through the triac 130, which is operable to control the intensity of the lighting load 104.

A night light feature of the dimmer 10 is provided by a source of illumination, e.g., a night light circuit 142, which is coupled in parallel electrical connection with the switch mechanism 140. The night light circuit 142 comprises two light-emitting diodes (LEDs) 144, 145 (i.e., two sources of illumination), which are coupled in parallel electrical connection in reverse directions. In other words, the anode of the first LED 144 is coupled to the cathode of the second LED 145 and the cathode of the first LED 144 is coupled to the anode of the second LED 145. Accordingly, the first LED 144 and the second LED 145 conduct current, and are thus illuminated, during the positive half-cycles and the negative half-cycles of the AC power source 102, respectively. The LEDs 144, 145 are physically located such that the LEDs emit light towards the pushbutton 122, the actuator knob 126, and the elongated slot 128 (FIGS. 2 and 3). The LEDs 144, 145 are preferably part number TLHF 4200, manufactured by Vishay Semiconductors.

The parallel combination of the LEDs 144, 145 is coupled in series with two resistors 146, 148 that preferably have resistances of 120 kΩ and 150 kΩ, respectively. The resistors 146, 148 limit the magnitude of the current that flows through the resistors and the LEDs 144, 145.

Since the night light circuit 142 is coupled in parallel electrical connection with the switch mechanism 140, no current flows through the LEDs 144, 145 when the switch mechanism 140 is in the closed position. Accordingly, the LEDs 144, 145 do not illuminate when the lighting load 104 is on. On the other hand, when the switch mechanism 140 is in the open position and the lighting load 56 is off, a current flows through the night light circuit 142 and the capacitor 139 of the EMI filter 137. This current is sufficiently large to cause the first LED 144 to illuminate during the positive half-cycles and the second LED 145 to illuminate during the negative half-cycles, but is not large enough to cause the lighting load 56 to illuminate.

FIG. 5 is a top cross-sectional view and FIG. 6 is a left-side cross-sectional view of the dimmer switch 100. The pushbutton 122 moves linearly towards and away from the front surface of the faceplate 110, i.e., perpendicularly to the plane of the faceplate in the direction of the Z-axis. The pushbutton 122 and frame 125 are part of an actuator assembly 150 that provides for switching actuation of the switch mechanism 140 of the dimmer switch 100. The actuator assembly 150 actuates the switch mechanism 140 when force is applied to an outer front surface 151 of the pushbutton 122 by, for example, a user's finger. The actuator assembly 150 also provides a biasing force for outward return of the pushbutton 122 following release of the applied force.

Figure 7:
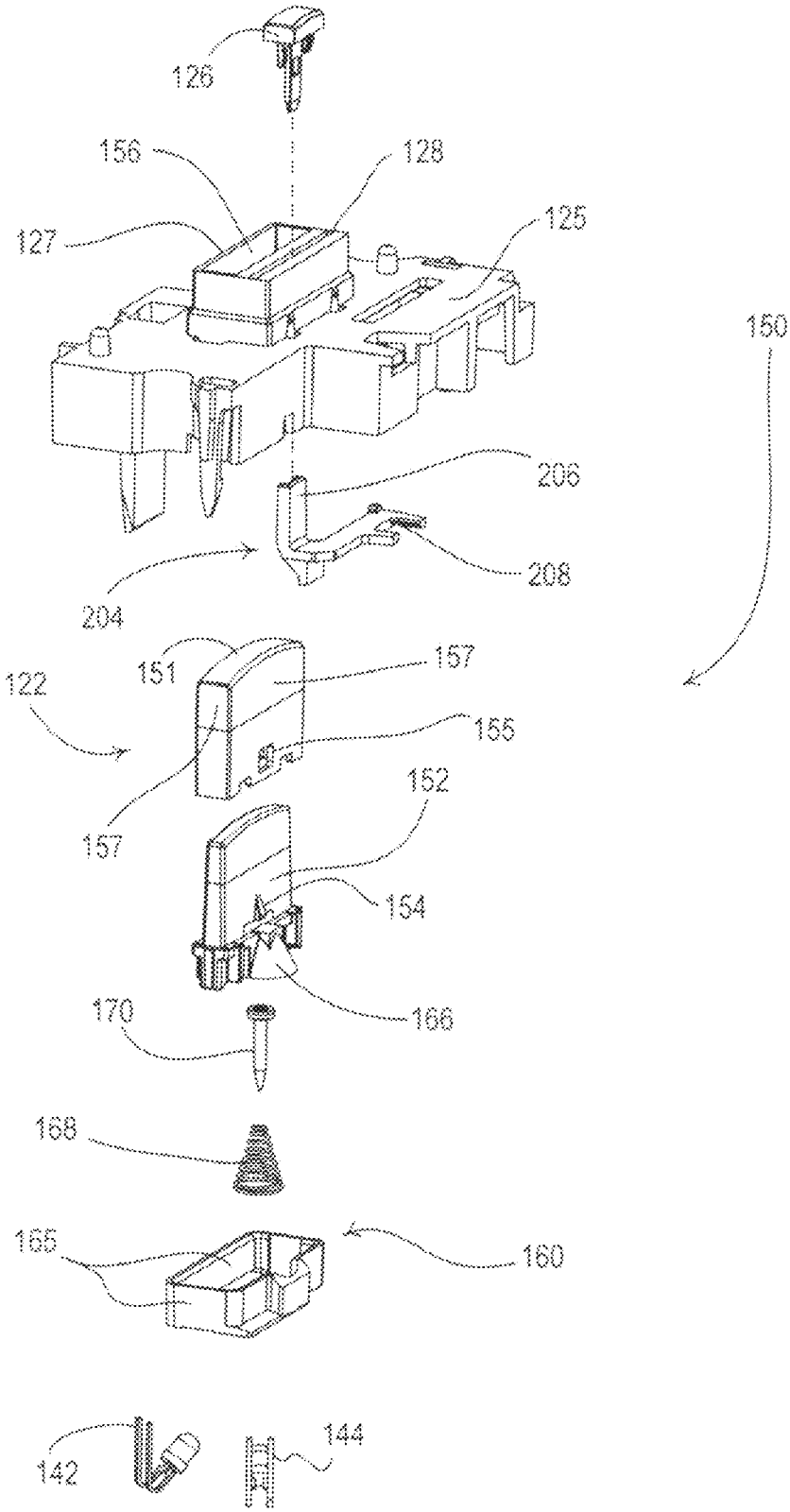
FIG. 7 is an exploded view of an actuator assembly of the dimmer switch of FIG. 2.
Figure 8:
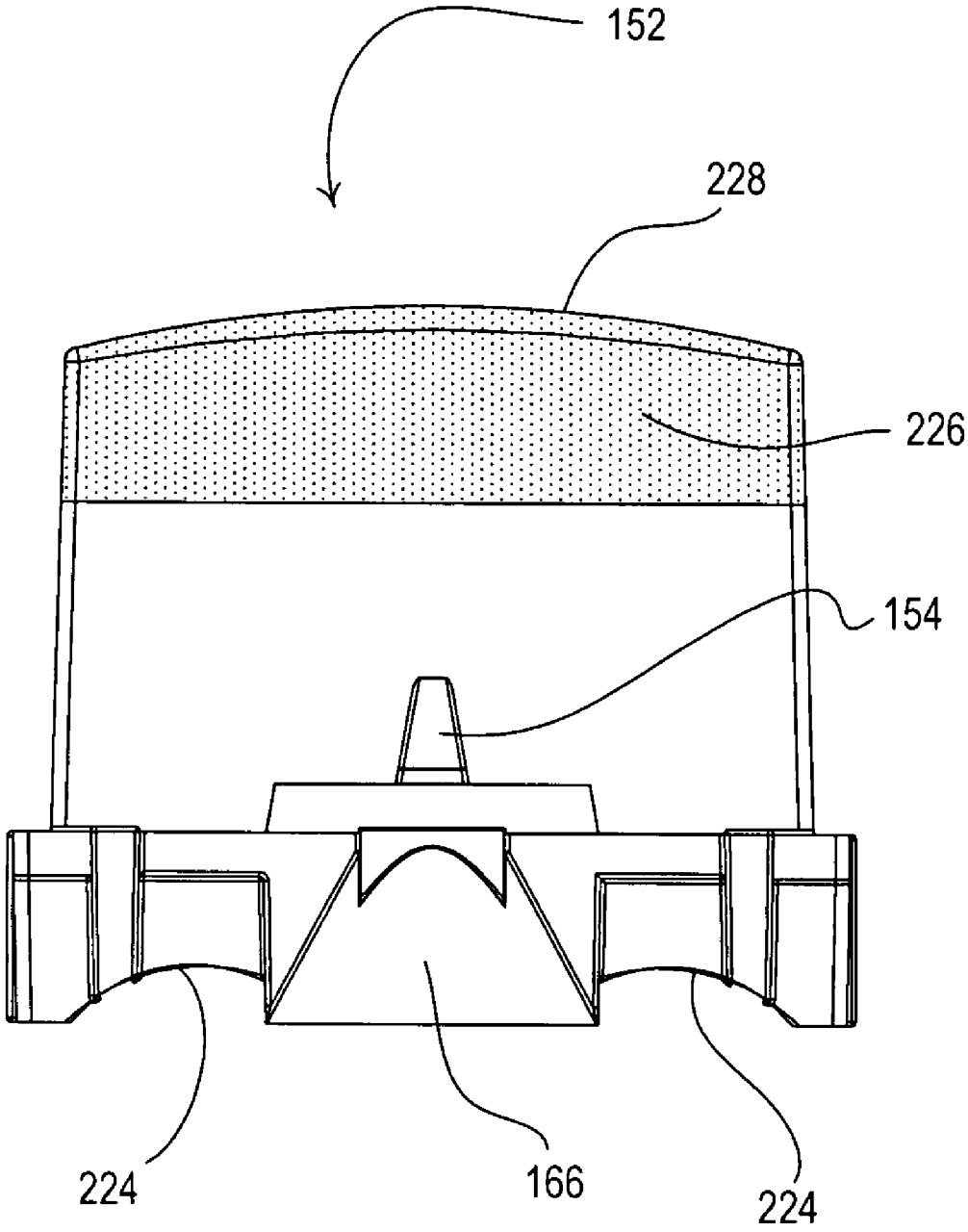
FIG. 8 is a right-side view of a sub-button of the dimmer switch of FIG. 2.

FIG. 7 is an exploded view of the actuator assembly 150, which comprises a sub-button 152. FIG. 8 is a right-side view of the sub-button 152. The pushbutton 122 forms a hollow body and the sub-button 152 is dimensioned for receipt within an interior defined by the pushbutton. The sub-button 152 extends through the interior of the pushbutton 122, but does not contact an inner front surface 153 of the pushbutton 122. The sub-button 152 includes a snap projection 154 adapted for snap receipt by a snap opening 155 formed in a sidewall 157 of the pushbutton 122 to releasably secure the pushbutton to the sub-button. The pushbutton 122 and the base of the sub-button 152 are dimensioned for sliding receipt in an opening 156 of the frame 125. The elongated slot 128 extends parallel to the opening 156 in the frame the elongated opening and laterally spaced therefrom.

Figure 9A:
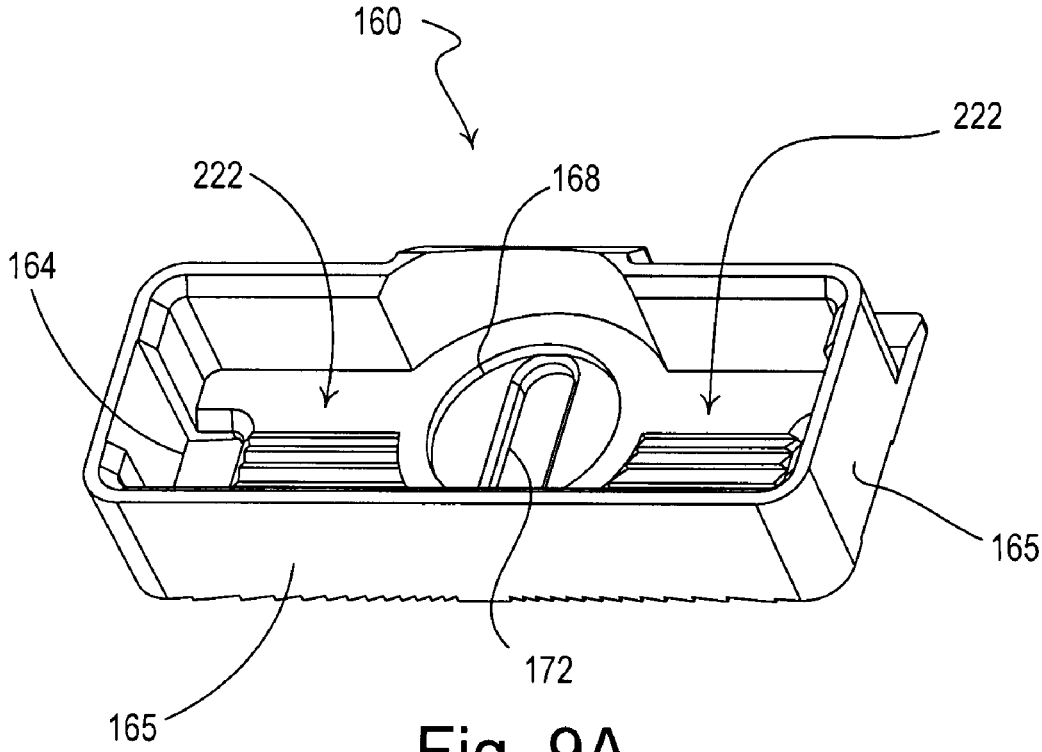
FIGS. 9A and 9B are perspective views of a retainer of the dimmer switch of FIG. 2.
Figure 9B:
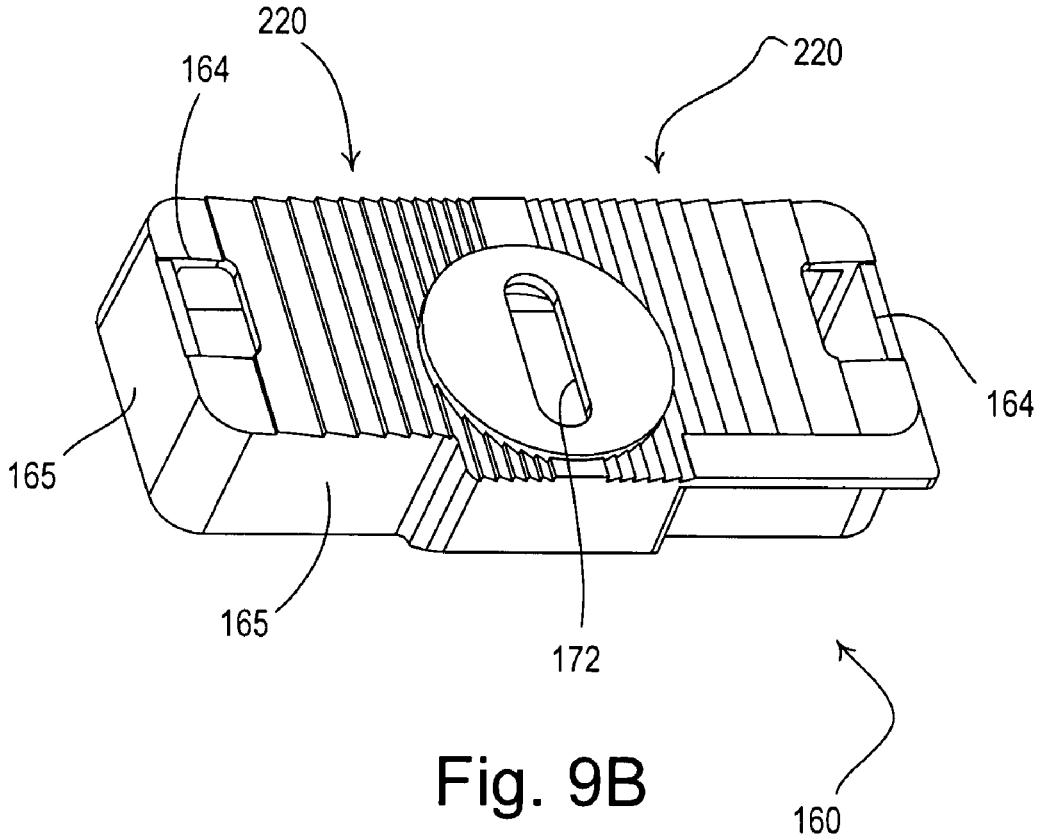

The actuator assembly 150 also includes a pushbutton return spring 158 located between the sub-button 152 and a retainer 160 to outwardly bias the pushbutton 122. FIGS. 9A and 9B are perspective views of the retainer 160. The retainer 160 is secured to the frame 125 to provide a reaction surface for compression of the pushbutton return spring 158 during inward translation of the pushbutton 122. The compression of pushbutton return spring 158 provides for outward return of the pushbutton 122 following removal of the actuating force from the pushbutton. Elongated tabs 162 (FIG. 6) extending from the frame 125 are received by openings 164 of retainer 160 for releasable connection between the retainer and the frame. The retainer 160 also includes upstanding sidewall portions 165 such that the retainer defines a tray-like construction. The pushbutton return spring 158 is conical in shape and is received within a bell-shaped receptacle 166 of the sub-button 152. The other end of pushbutton return spring 158 is received in a recessed portion 168 of the retainer 160.

The actuator assembly 150 also includes a pin 170, preferably made from a plastic material. The pin 170 is received through the upper end of the return spring 158 such that a head portion of the pin contacts the upper end of the pushbutton return spring 158. When force is applied to the pushbutton 122, e.g., by a user's finger, the pin 170 is driven through an opening 172 in the recessed portion 168 of retainer 160 compressing the pushbutton return spring 158. The opening 172 in the retainer 160 forms an elongated slot, which allows the pin 170 to pivot laterally with respect to the retainer 160, which allows the pin to actuate the switch mechanism 140.

Figure 10:
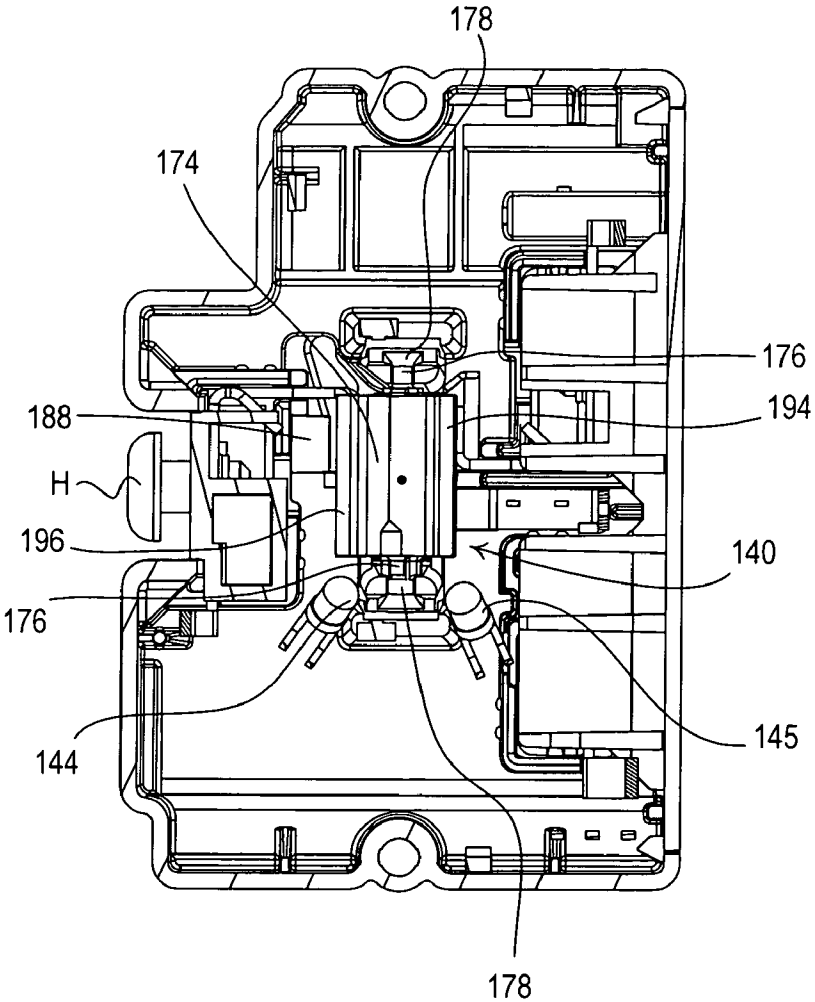
FIG. 10 is a front cross-sectional view of the dimmer switch of FIG. 2.

Actuation of the switch mechanism 140 by the actuator assembly 150 results in switching of the switch mechanism between the alternate open and closed positions. The switch mechanism 150 includes a pivot member 174 having posts 175 extending from opposite ends. FIG. 10 is a front cross-sectional view of the dimmer switch 100 showing the pivot member 174. The posts 176 are received in openings in upstanding supports 178 of the back enclosure 118 for rotatable support of the pivot member.

As shown in FIGS. 5 and 6, the switch mechanism 140 also includes a switch plate 180 supported by a switch plate holder 182 connected to the back enclosure 118. The switch plate 180 comprises an electrical contact 184 and legs 186, which are electrically connected to the electrical contact. The legs 186 contact the switch plate holder 182 and provide an electrical connection between the switch plate holder and the electrical contact 184.

The hot terminal H of the dimmer switch 100 includes a contact element 188 (FIG. 10). The switch plate holder 180 is operable to pivot between a first position (as shown in FIGS. 5 and 6) and a second position. In the first position, the electrical contact 184 of the switch plate 180 does not contact the contact element 188. However, in the second position, the electrical contact 184 contacts the contact element 188, thus, electrically connecting the switch plate holder 182 and the hot terminal H. Accordingly, the first position of the switch plate 180 corresponds to the open position of the switch mechanism 140 and the second position of the switch plate corresponds to the closed position of the switch mechanism.

The pivot member 174 includes downwardly extending legs 190 at opposite ends. Each leg 190 defines a recess adapted to receive an upper edge of the switch plate 180 adjacent opposite ends of the switch plate. The switch plate 180 is operable to pivot from the first position to the second position in response to the movement of the pivot member. A pivot spring 192 is located between the pivot member 174 and the switch plate 180. Located in this manner, the spring 192 reacts against the pivot member 174 and applies force to the switch plate 180 for maintaining the switch plate in one of the alternate fixed positions, i.e., the first position or the second position.

Application of force to the pushbutton 122 results in inward translation of the pushbutton 122 and the sub-button 152 through the opening 156 in the frame 125 and the extension of the pin 170 through the opening 172 in the retainer 160. The pin 170 translates across the surface of the pivot member 174 and contacts an extension 194 of the pivot member, which forces the pivot member to pivot. The downwardly extending legs 190 of the pivot member 174 contact the switch plate 180 as the pivot member is pivoted, thus changing the switch mechanism 140 between the open and closed positions. After the pivot member 174 has changed positions and the pushbutton 122 has returned to the normal state (i.e., the initial position), the pin 170 is operable to contact the other extension 196 of the pivot member upon the next actuation of the pushbutton 122. The operation of the switch mechanism 140 and the actuator assembly 150 is described in greater detail in U.S. Pat. No. 7,105,763, issued Sep. 12, 1006, entitled SWITCH ASSEMBLY, the entire disclosure of which is hereby incorporated by reference.

Figure 11:
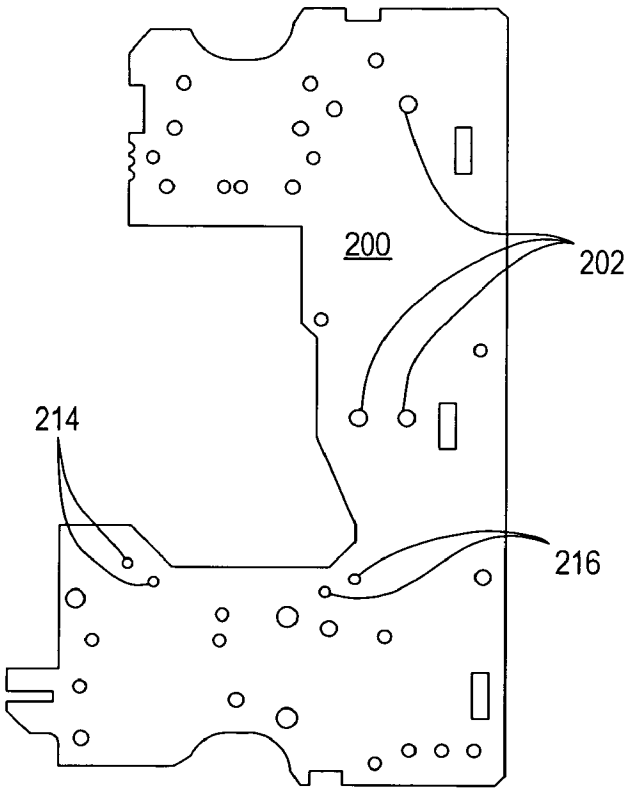
FIG. 11 is a front view of a printed circuit board of the dimmer switch of FIG. 2.

The electrical circuitry of the dimmer switch 100 (i.e., the triac 130, the timing circuit 132, the diac 136, the EMI filter 137, and the night light circuit 142) is coupled to a printed circuit board (PCB) 200, which is mounted in the back enclosure 118. FIG. 11 is a front view of the PCB 200. The switch plate holder 182 is electrically connected with the PCB 200, such that when the switch mechanism 140 is in the closed position the hot terminal H is electrically coupled to the triac 130. Since the night light circuit 142 is coupled in parallel with the switch mechanism 140, the hot terminal H is also electrically connected to the PCB 200.

The potentiometer 134 of the timing circuit 132 preferably comprises a linear slide potentiometer and is mounted to through-holes 202 of the PCB 200. The actuator knob 126 of the intensity actuator 124 is coupled to the potentiometer 134 through the elongated slot 128 in the frame 125 via a slide member 204 as shown in FIG. 7. The slide member 204 includes a post 206, which extends through the elongated slot 128 and connects to the actuator knob 126. An attachment portion 208 of the slide member 204 contacts an adjustment member (not shown) of the potentiometer, which allows for adjustment of the resistance of the potentiometer. Accordingly, a user is operable to adjust the intensity of the lighting load 104 by moving the actuator knob 126 of the user interface 120.

Figure 12:
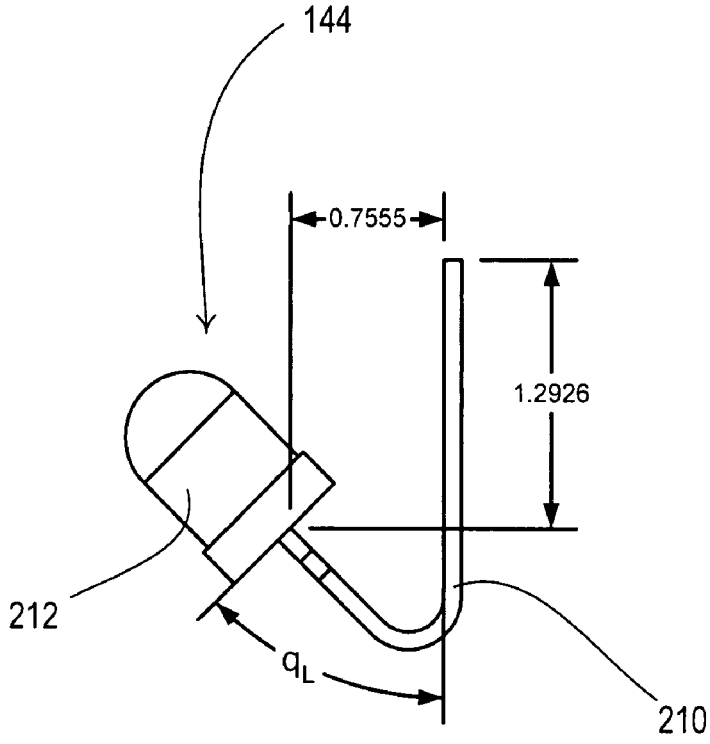
FIG. 12 is a side view of a light-emitting diode of the dimmer switch of FIG. 2.

The LEDs 144, 145 are positioned below the switch mechanism 140, i.e., offset longitudinally from the switch mechanism, as shown in FIGS. 6 and 10. The LEDs 144, 145 preferably point up towards the user interface 120 to illuminate the pushbutton 122 and the elongated slot 128. FIG. 12 is a side view of one of the LEDs 144, 145. Each LED 144, 145 comprises two leads 210, which are each preferably bent at an angle $\theta_L$, e.g., 45°, to allow a lens 212 of each LED to shine up towards the user interface 120. The LEDs 144, 145 are mounted to respective pairs of through-holes 214, 216 at angles with respect to both the vertical and horizontal axes of the dimmer switch 100 (i.e., the X-axis and the Y-axis, respectively, as shown in FIG. 3) to direct the light from the LEDs towards the user interface 120.

The sub-button 152, the retainer 160, and the slide member 204 are made of a substantially transparent (i.e., translucent) material, such that these parts are operable to transmit light from the LEDs 144, 145 to the user interface 120, specifically, the outer front surface 151 of the pushbutton 122 and the elongated slot 128. The sub-button 152 comprises an optically-conductive structure that specifically functions to illuminate the front portion of the pushbutton 122. The front surface (i.e., between the outer front surface 151 and the inner front surface 153) and the sidewalls 157 of the pushbutton 122 are preferably thin and translucent such that the outer front surface 151 and the sidewalls 157 of the pushbutton glow when the LEDs 144, 145 are illuminated. The frame 125 and the adjustment knob 126 are made of an opaque material, such that when the LEDs 144, 145 are on, the light emitted from the LEDs shines through the elongated slot 128 of the intensity actuator 124.

Figure 13:
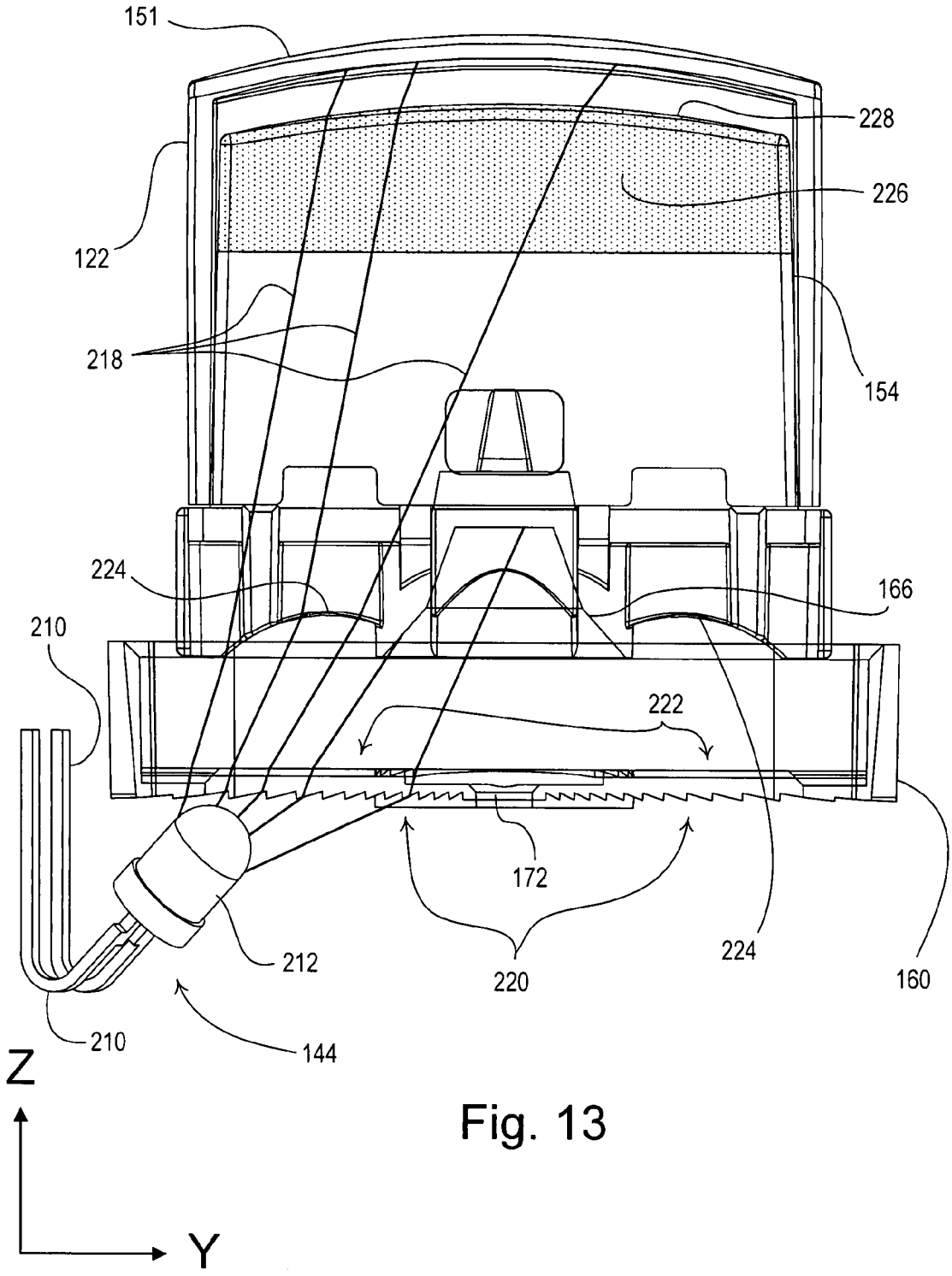
FIG. 13 is a side view of the sub-button and the retainer demonstrating the transmission of light rays from the light-emitting diode in the dimmer switch of FIG. 2.

Preferably, the front portion of the pushbutton 122 (i.e., the portion of the pushbutton visible to a user) is illuminated uniformly. To accomplish this, the sub-button 152 and the retainer 160 provide a plurality of lenses (i.e., a lens structure) to direct the light emitted from the LEDs to the front surface 151 of the pushbutton 122. FIG. 13 is a side view of the sub-button 152 and the retainer 160 demonstrating the transmission of light rays 218 from the lens 212 of the LED 144. The retainer 160 provides a first Fresnel lens pattern 220 on the rear surface and a second Fresnel lens pattern 222 on the inner front surface to redirect the light rays 218 towards the sub-button 152. The sub-button 152 provides a convex lens 224 (i.e., a third lens) on the rear surface for redirecting and diverging the light rays 218 towards the front surface 151 of the pushbutton 122. The sub-button 152 further comprises a textured portion 226 (i.e., a fourth lens) for diffusing the light rays to all surfaces on the front portion of the pushbutton 122 (i.e., including the front surface 151 and the sidewalls 157).

Figure 14A:
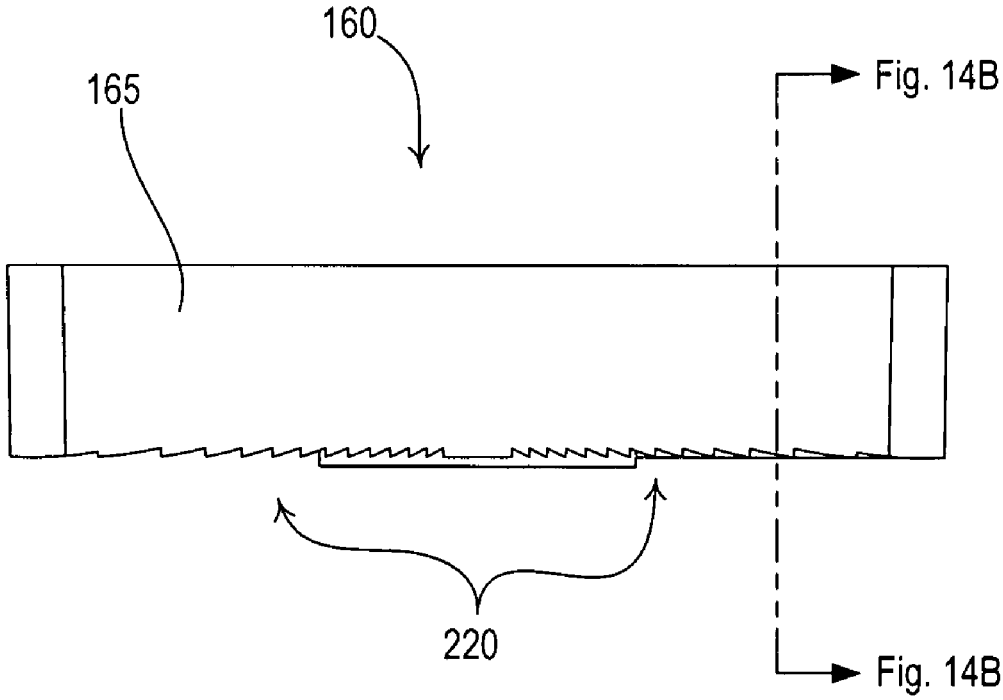
FIG. 14A is a left-side view of the retainer of FIGS. 9A and 9B showing a first Fresnel lens.
Figure 14B:
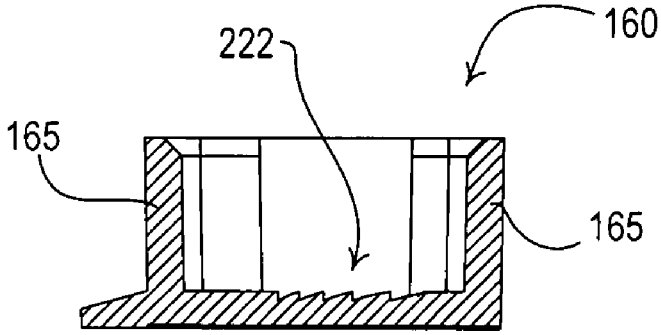
FIG. 14B is a top cross-sectional view of the retainer of FIGS. 9A and 9B showing the second Fresnel lens.

FIG. 14A is a left-side view of the retainer 160 showing the first Fresnel lens pattern 220 and FIG. 14B is a top cross-sectional view of the retainer showing the second Fresnel lens pattern 222. The first and second Fresnel lens patterns 220, 222 each include a plurality of parallel striations, with each of the parallel striations forming a ramping structure. The parallel striations of the first Fresnel lens pattern 220 are arranged in the lateral direction (i.e., in the direction of the X-axis), while the parallel striations of the second Fresnel lens pattern 222 are arranged along the longitudinal direction (i.e., in the direction of the Y-axis). The first and second Fresnel lens patterns 220, 222 operate to direct the light rays 218 towards the sub-button 152. The first Fresnel lens pattern 220 redirects the rays 218 from the LEDs 144, 145 in the longitudinal direction and the second Fresnel lens pattern 222 redirects the light rays 218 from the LEDs 144, 145 in the lateral direction away from the sidewalls 157 towards the front surface of the pushbutton 122.

The convex lens 224 is formed in the rear surface of the sub-button 152 and operates to redirect the light rays 218 towards the front surface 151 of the pushbutton 122, while also diverging the light rays across the front surface. As previously described, the bell-shaped receptacle 166 of the sub-button 152 receives the return spring 158. The bell-shaped receptacle is not designed to redirect the light rays 218. The first and second Fresnel lens patterns 220, 222 of the retainer 160 redirect the light rays 218 towards the convex lens 224 and the convex lens redirects the light rays towards the inner front surface 153 of the pushbutton 122 (i.e., around the bell-shaped receptacle 166). The convex lens 224 also diffuses the light rays 218 across the inner front surface 153 of the pushbutton 122 to uniformly illuminate and avoid "hot spots" on the outer front surface 151 of the pushbutton. The textured portion 226 of the sub-button 152 operates to further diffuse the light rays 218 uniformly to the front surface 151 and the sidewalls 157 of the pushbutton 122.

The light rays 218 are also refracted by a front surface 228 of the sub-button 152 to contact the inner front surface 153 and thus illuminate the outer front surface 151 of the pushbutton 122. Preferably, the distance between the front surface 228 of the sub-button 152 and the inner front surface 153 of the pushbutton 122 is substantially constant across the length of the front surface of the sub-button 152. Accordingly, the LEDs 144, 145 are in optical communication with the inner front surface 153 of the pushbutton 122.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A wall-mountable electrical load control structure for controlling the power to be applied to an electrical load, said load control structure comprising:

a support frame having a front surface and a rear surface, the front surface defining an elongated rectangular opening therein, the rectangular opening having a length which is greater than its width;

an enclosure secured to and extending from the rear surface of said support frame;

a generally-flat cover plate secured relative to the front surface of said support frame, said cover plate defining a plane and having a centrally disposed rectangular opening;

an elongated rectangular pushbutton slidably received with respect to said elongated opening of said support frame and passing through said rectangular opening in said cover plate, said pushbutton moveable perpendicularly to the plane of said cover plate;

a switch mechanism supported in said enclosure and coupled to said elongated pushbutton, such that said pushbutton is operable to cause said switch mechanism to turn the power to said electrical load on and off in response to the operation of said pushbutton;

a source of illumination supported behind said support frame and located adjacent said switch mechanism, said source of illumination electrically energized when the power to said electrical load is turned off, said pushbutton having at least a translucent surface portion which is positioned to be illuminated by said source of illumination when said source of illumination is energized;

an actuator assembly operatively coupled between said pushbutton and said switch mechanism, at least a portion of said actuator assembly operable to transmit light from said source of illumination to said translucent surface portion of said pushbutton;

a variable-intensity control circuit coupleable to said electrical load; and a slider control for varying said intensity control circuit to control the amount of power delivered to said electrical load, said support frame having a vertical slot extending parallel to its said elongated opening and laterally spaced therefrom, said slider control comprising a shaft that extends perpendicularly through said slot and having an operating knob at its outer end and connected to said variable-intensity control circuit at its other end, said slot adapted to be illuminated by said source of illumination when said source of illumination is energized.

2. The control structure of claim 1, wherein said operating knob is rectangular in shape.

3. The control structure of claim 2, wherein said knob has a top rectangular surface, the vertical sides of said knob being chamfered.

4. The control structure of claim 3, wherein said pushbutton has a top rectangular surface, the parallel side edges of said top rectangular surface being chamfered.

5. The control structure of claim 4, wherein said pushbutton has a top rectangular surface that is translucent.

6. The control structure of claim 2, wherein said knob has a width equal to the width of said pushbutton.

7. The control structure of claim 6, wherein said rectangular opening in said cover plate has a length only slightly larger than the length of said pushbutton and a width only slightly larger than the sum of the widths of said pushbutton and said knob.

8. The control structure of claim 6, wherein the length of said knob is less than one half the length of said pushbutton.

9. The control structure of claim 1, wherein said frame has a thin rectangular shroud section extending therefrom and into said rectangular opening in said cover plate, said elongated rectangular pushbutton extending through and at least partly surrounded by said shroud, said shroud preventing the application of binding force to said rectangular pushbutton from the interior edges of said rectangular opening in said cover plate due to a lateral displacement of said rectangular cover plate relative to said frame.

10. The control structure of claim 9, wherein said operating knob is rectangular in shape.

11. The control structure of claim 10, wherein said operating knob has a width equal to the width of said pushbutton.

12. The control structure of claim 11, wherein the length of said operating knob is less than one half the length of said pushbutton.

13. The control structure of claim 10, wherein the top surface of said pushbutton is adapted to be substantially coplanar with a top surface of said knob when said pushbutton is fully depressed.

14. The control structure of claim 9, wherein said frame and said thin shroud are formed as an integrally molded plastic part.

15. A method of illuminating a slider slot of a wall-mounted dimmer switch to identify the location of said dimmer switch in a darkened room, said dimmer switch comprising a dimmer slider knob that is moveable between the ends of said slot, said method comprising the steps of:

coupling said slider knob to a potentiometer contained interiorly of said dimmer switch via a slide member, said potentiometer offset laterally from said slot, such that said slide member is not visible in the portions of said slot which are unoccupied by said slider knob;

illuminating a light source contained interiorly of said dimmer switch; and directing said light source towards the rear of said slot;

wherein illumination is visible in the portions of said slot which are unoccupied by said slider knob.

16. The method of claim 15, wherein the step of illuminating further comprises illuminating said light source contained interiorly of said dimmer switch when said dimmer switch is turned off.

17. The method of claim 15, further comprising the step of:

directing said light source to illuminate said slot and a toggle actuator of said dimmer switch.

18. A wall-mountable electrical load control structure for controlling the power to be applied to an electrical load, said load control structure comprising:

a support frame having an elongated rectangular opening therein, said rectangular opening having a length which is greater than its width;

an enclosure secured to and extending from the rear surface of said support frame;

a cover plate secured to the front surface of said support frame, said cover plate having a centrally disposed rectangular opening;

an elongated rectangular pushbutton having a translucent surface slidably received with respect to said elongated opening and passing through said rectangular opening in said cover plate and moveable perpendicularly to the plane of said cover plate;

a switch mechanism supported in said enclosure and coupled to said elongated pushbutton, such that said pushbutton is operable to cause said switch mechanism to turn the power to said electrical load on and off in response to the operation of said pushbutton;

a source of illumination supported behind said support frame and located adjacent said switch mechanism, said source of illumination electrically energized when the power to said electrical load is turned off;

an actuator assembly operatively coupled between said pushbutton and said switch mechanism, at least a portion of said actuator assembly operable to transmit light from said source of illumination to said translucent surface portion of said pushbutton;

a thin shroud extending from said frame and into said rectangular opening in said cover plate, said elongated rectangular pushbutton extending through and at least partly surrounded by said shroud, said shroud preventing the application of binding force to said rectangular pushbutton from the interior edges of said rectangular opening in said cover plate due to a lateral displacement of said cover plate relative to said frame;

a variable-intensity control circuit coupleable to said electrical load; and a slider control for varying said intensity control circuit to control the amount of power delivered to said electrical load, said support frame having a vertical slot extending parallel to its said elongated opening and laterally spaced therefrom, said slider control comprising a shaft that extends perpendicularly through said slot and having an operating knob at its outer end and connected to said variable-intensity control circuit at its other end, said operating knob being enclosed on its outer side by a respective portion of said shroud.

19. The control structure of claim 18, wherein said operating knob is rectangular in shape.

20. The control structure of claim 19, wherein said knob has a width substantially equal to the width of said pushbutton.

21. The control structure of claim 19, wherein said knob has a top rectangular surface, the lateral edges of the top rectangular surface of said knob being chamfered.

22. The control structure of claim 18, wherein said pushbutton has a top rectangular surface that is translucent.

23. The control structure of claim 18, wherein said pushbutton has a top rectangular surface, the parallel side edges of said top rectangular surface being chamfered.

24. A wall-mountable electrical load control structure for controlling the power to be applied to an electrical load, said load control structure comprising:

a support frame having a front surface and a rear surface, the front surface defining an elongated rectangular opening therein, the rectangular opening having a length which is greater than its width;

an enclosure secured to and extending from the rear surface of said support frame;

a generally-flat cover late secured relative to the front surface of said support frame, said cover plate defining a plane and having a centrally disposed rectangular opening;

an elongated rectangular pushbutton slidably received with respect to said elongated opening of said support frame and passing through said rectangular opening in said cover plate, said pushbutton moveable perpendicularly to the plane of said cover plate;

a switch mechanism supported in said enclosure and coupled to said elongated pushbutton, such that said pushbutton is operable to cause said switch mechanism to turn the power to said electrical load on and off in response to the operation of said pushbutton;

a source of illumination supported behind said support frame and located adjacent said switch mechanism, said source of illumination electrically energized when the power to said electrical load is turned off, said pushbutton having at least a translucent surface portion which is positioned to be illuminated by said source of illumination when said source of illumination is energized; and an actuator assembly operatively coupled between said pushbutton and said switch mechanism, at least a portion of said actuator assembly operable to transmit light from said source of illumination to said translucent surface portion of said pushbutton, said actuator assembly comprising a retainer and a return spring coupled between said retainer and said pushbutton to outwardly bias said pushbutton, said retainer operable to transmit light from said source of illumination to said translucent surface portion of said pushbutton.

25. The control structure of claim 24, wherein said retainer portion comprises a first Fresnel lens pattern arranged in a longitudinal direction and a second Fresnel lens pattern arranged in a lateral direction, said first and second Fresnel lens patterns operable to redirect the light emitted from said source of illumination towards said translucent surface portion of said pushbutton.

26. The control structure of claim 24, wherein said source of illumination is offset longitudinally from said switch mechanism and is positioned to emit light towards said translucent surface portion of said pushbutton.

27. The control structure of claim 24, wherein said switch mechanism comprises a switch plate and a pivot member operable to cause the switch plate to pivot between a first position in which power is applied to said electrical load and a second position in which power is not applied to said electrical load.

28. A wall-mountable electrical load control structure for controlling the power to be applied to an electrical load, said load control structure comprising:

a support frame having an elongated rectangular opening therein, said rectangular opening having a length which is greater than its width;

an enclosure secured to and extending from the rear surface of said support frame;

a cover plate secured to the front surface of said support frame, said cover plate having a centrally disposed rectangular opening;

an elongated rectangular pushbutton having a translucent surface slidably received with respect to said elongated opening and passing through said rectangular opening in said cover plate and moveable perpendicularly to the plane of said cover plate;

a switch mechanism supported in said enclosure and coupled to said elongated pushbutton, such that said pushbutton is operable to cause said switch mechanism to turn the power to said electrical load on and off in response to the operation of said pushbutton;

a source of illumination supported behind said support frame and located adjacent said switch mechanism, said source of illumination electrically energized when the power to said electrical load is turned off;

an actuator assembly operatively coupled between said pushbutton and said switch mechanism, at least a portion of said actuator assembly operable to transmit light from said source of illumination to said translucent surface portion of said pushbutton; and a thin shroud extending from said frame and into said rectangular opening in said cover plate, said elongated rectangular pushbutton extending through and at least partly surrounded by said shroud, said shroud preventing the application of binding force to said rectangular pushbutton from the interior edges of said rectangular opening in said cover plate due to a lateral displacement of said cover plate relative to said frame;

wherein said actuator assembly comprises a retainer and a return spring coupled between said retainer and said pushbutton to outwardly bias said pushbutton, said retainer operable to transmit light from said source of illumination to said translucent surface portion of said pushbutton.

29. The control structure of claim 28, wherein said retainer portion comprises a first Fresnel lens pattern arranged in a longitudinal direction and a second Fresnel lens pattern arranged in a lateral direction, said first and second Fresnel lens patterns operable to redirect the light emitted from said source of illumination towards said translucent surface portion of said pushbutton.

30. The control structure of claim 28, wherein said source of illumination is offset longitudinally from said switch mechanism and is positioned to emit light towards said translucent surface portion of said pushbutton.

31. The control structure of claim 28, wherein said switch mechanism comprises a switch plate and a pivot member operable to cause the switch plate to pivot between a first position in which power is applied to said electrical load and a second position in which power is not applied to said electrical load.

32. A control structure for an electrical circuit for controlling the power to be applied from an AC power source to an electrical system, said control structure comprising:

a toggle button having a flat rectangular hollow plastic body and a translucent outer front surface;

a support structure for supporting said toggle button for linear motion perpendicular to said front surface;

an optically-conductive structure supported within said hollow plastic body of said toggle button, said optically-conductive structure having a first end surface facing an interior surface of said translucent outer top surface and a second end surface opposite to said first end surface;

at least one light-emitting diode facing said second end surface for illuminating said second end surface whereby the light illumination on said second end surface is conducted to said first end surface to illuminate said translucent outer top surface;

a circuit for energizing said at least one light-emitting diode when said electrical circuit is off;

a switch mechanism supported in said enclosure and located adjacent said at least one light-emitting diode, said switch mechanism operatively coupled to said toggle button, such that actuations of said toggle button cause said switch mechanism to turn the power to said electrical system on and off; and an actuator assembly operatively coupled between said toggle button and said switch mechanism, said actuator assembly comprising a lens structure disposed adjacent said at least one light emitting for directing ht through said optically-conductive structure to more uniformly illuminate said translucent outer top surface, said actuator assembly comprising a retainer and a return spring coupled between said retainer and said pushbutton to outwardly bias said pushbutton, said retainer operable to transmit light from said source of illumination to said translucent surface portion of said pushbutton.

* * * * *